United States Patent [19]

Meyers

[11] 4,448,359

[45] May 15, 1984

[54] COMBINATION DRAIN PUMP AND GRINDING APPARATUS

[75] Inventor: Theodore F. Meyers, Troy, Ohio

[73] Assignee: Hobart Corporation, Troy, Ohio

[21] Appl. No.: 387,067

[22] Filed: Jun. 10, 1982

[51] Int. Cl.[3] ..... B02C 18/42

[52] U.S. Cl. ..... 241/46.06; 241/92; 241/257 R; 241/261; 134/115 G

[58] Field of Search ..... 241/46.02, 46.06, 46.11, 241/46.17, 83, 91, 92, 46 B, 100.5, 257 R, 257 G, 261; 134/115 R, 115 G, 57 D, 58 D, 56 D; 415/121 B

[56] References Cited

U.S. PATENT DOCUMENTS

| | | | |
|---|---|---|---|
| 2,761,627 | 9/1956 | Reed | 241/46.06 X |
| 2,828,083 | 3/1958 | Macemon | 241/46 |
| 2,828,084 | 3/1958 | James et al. | 241/46 |
| 2,828,086 | 3/1958 | Macemon | 241/100.5 |
| 2,836,369 | 5/1958 | Strehlow et al. | 241/46 |
| 2,928,615 | 3/1960 | Strehlow et al. | 241/100.5 |
| 2,959,179 | 11/1960 | Sasnett et al. | 134/186 |
| 3,071,328 | 1/1963 | Higer | 241/46 |
| 3,079,094 | 2/1963 | Brezosky et al. | 241/46 |
| 3,080,874 | 3/1963 | Brucken | 134/115 |
| 3,179,307 | 4/1965 | Duncan et al. | 222/333 |
| 3,310,243 | 3/1967 | Duncan et al. | 241/46.17 X |
| 3,356,097 | 12/1967 | Schaap | 134/112 |
| 3,370,598 | 2/1968 | Lopp et al. | 134/111 |
| 3,425,355 | 2/1969 | LaFlame et al. | 103/3 |
| 3,810,480 | 5/1974 | Smith et al. | 134/104 |
| 4,038,103 | 7/1977 | Grunewald | 134/10 |
| 4,228,962 | 10/1980 | Dingler et al. | 241/46 |

*Primary Examiner*—Mark Rosenbaum
*Assistant Examiner*—Joseph M. Gorski
*Attorney, Agent, or Firm*—Biebel, French & Nauman

[57] ABSTRACT

A combination drain pump/disposer is used with a vessel such as a dishwasher and includes a housing defining an impeller cavity, an inlet above the housing which communicates with the vessel, a pump outlet extending through a side wall of the cavity and communicating with the drain line, and a waste impeller positioned within the cavity. The impeller includes a disc-shaped base substantially parallel to and spaced slightly above the floor of the cavity, a plurality of soil-sizing orifices, an upstanding rim extending about a periphery of the base and including an inner wall defining a plurality of radially-extending, substantially vertical cutting edges and an outer wall defining a plurality of radially-extending, substantially vertical pumping vanes, and at least one breaker tooth extending upwardly from the base and positioned inwardly of the rim. The housing includes a cover plate having an opening concentric with the impeller and at least one stationary tooth providing a vertical cutting edge extending downwardly adjacent the inner wall such that rotation of the impeller causes the cutting edges and breaker tooth to pass by the stationary tooth to perform a shearing and cutting function.

8 Claims, 7 Drawing Figures

COMBINATION DRAIN PUMP AND GRINDING APPARATUS

BACKGROUND OF THE INVENTION

1. Field of the Invention

The present invention relates to ware washing machines, and more particularly, to domestic or household-type dishwashers having pump assemblies which drain the wash chamber and grind food.

2. Prior Art

Many dishwashers are provided with drain pumps which drain the washing solution from the sump of the dishwashing tank and at the same time grind up or comminute relatively soft food soil particles suspended in the dishwashing solution drained from the sump. Generally speaking, these small disposers used in dishwashers have been designed to handle only "soft foods." Their purpose was primarily to reduce particle size of soft food to prevent plugging of wash arm nozzles in that type of domestic dishwasher which did not filter recirculated wash solution, and also to grind any soft food en route to a drain, in both filtered and unfiltered systems.

However, toothpicks, cherry and olive pits, cigarette filter tips, chips of glass and other hard or stringy objects also find their way into the sump. Unless they are trapped by a coarse filter covering the inlet to the disposer, they can enter the drain. Sometimes they will pass through the coarse filter and cause clogging of the system despite the presence of a soft food disposer. If either the impeller or stator of the soft food disposer is made of a plastic such as a phenolic, a hard item passing through the disposer can break parts which must then be replaced. If a coarse filter is used, it often includes labyrinthine passages to prevent long, thin objects such as toothpicks or bones from bending around short curves, while permitting passage of items such as corn, peas, cherry pits, and the like. Corn and peas can be ground in a disposer easily because they are relatively soft, but hard items such as cherry pits present a serious problem for these types of disposers.

If a flat, coarse filter were used, the openings in the filter typically would be of a size large enough such that soft items such as peas and corn would be passed to the disposer. However, a toothpick could approach the face of such a filter end first and pass straight through to cause a clogging problem. While some toothpicks are capable of cracking across the wood grain easily and being ground up by a soft food disposer, many have a long grain of such strength that they are easily bent without being broken. Whether toothpicks are trapped upstream by a coarse filter, or pass through it and cannot be cut up by the soft food disposer and are thus trapped downstream, they may create problems. Trapped toothpicks bridge across openings and capture other soil. If this occurs at the disposer itself, it may necessitate a service call. If it occurs at the coarse filter, it may result in unsatisfactory dishwashing. The reason for the latter is that trapped soil, by being unable to drain from the dishwasher at the end of any of the several discrete periods of a total dishwashing cycle, can partially break loose from time to time and get redeposited on the ware. Obviously, if this happens during the final rinse, unclean ware can result. In addition, depending on the degree to which the filter traps soil, the recirculating pump may be partially or wholly starved of a water supply.

There are several devices in the prior art which contain means to perform such draining and grinding or comminuting functions. These devices are equipped with drain and/or wash pump impellers that, either alone or in combination with stationary members, perform a comminuting function in order to reduce the oversized food and other particles that invariably would pass through coarse filters designed to retain them and cause clogging problems in the drain line or wash arm.

For example, U.S. Pat. No. 3,370,598 discloses a dishwasher having a drain pump which includes a drain impeller mounted on a common shaft with a circulating pump impeller which pumps washing solution to the spray arms. The drain impeller is positioned within a stationary shredder ring having slots spaced about its periphery through which the washing solution and food soil particles pass during both washing and draining cycles. Food soil is comminuted by the interaction of the slots of the stationary shredder ring and the blades of the impeller. The washing solution and comminuted food particles flow outwardly through the slots and downwardly to the inlet to the drain tube or line, positioned substantially below the drain impeller.

The drain pump assembly disclosed in that patent is representative of those devices which incorporate a stationary shredder ring surrounding the impeller for adapting the device to also function as a disposer. A disadvantage of this design is that, to operate efficiently as a pump as well as a disposer, the solution and comminuted particles must be subjected to pumping action after passage through the stationary shredder ring. Therefore, additional space must be provided below the impeller to accommodate the drain line inlet there as well as to expose the bottom of the impeller to the solution in order for the impeller to provide the needed pumping action.

Another disadvantage with this device is that some of the food particles are collected in the drain line downstream of the drain pump during the washing operation. Therefore, these particles make only one brief pass through the impeller prior to draining and may not be sufficiently reduced in size to eliminate a clogging problem.

U.S. Pat. No. 3,080,874 discloses a dishwasher having a waste disposer and comprising a single impeller mounted within a stationary, cup-shaped shredder ring. During draining, washing solution bearing food soil particles flows downwardly from the sump of the dishwashing tank onto the rotating impeller which propels the solution outwardly, the interaction of the shredder ring and impeller serving to comminute the food particles. A diverter valve positioned beneath the impeller directs the washing solution either to the spray arms or to a drain conduit.

While this type of device may save space in utilizing a single impeller, it possesses several disadvantages. The centrifugal pumping action of the impeller on the washing solution and particles would be substantially disrupted by the presence of the stationary shredder ring. Once the solution and particles flow through the shredder ring they are not subjected to any additional pumping action since the cup-shaped bottom of the shredder ring encloses the lower surface of the impeller. Another disadvantage is that there is no well-defined flow path for pumped fluid during either the washing or the draining modes. Fluid is pumped radially outwardly through the shredder ring, then must angle sharply downward, then sharply radially inward, then sharply upward or downward. The number of sharp turns reduces the efficiency of the pump.

There is also a disadvantage common to both of the aforementioned drain pumps. Since the components of the drain pump must be manufactured and assembled at a competitive price, these components are dimensioned to provide loose tolerances to allow for variations in size and fit. Thus, there must of necessity exist a gap between the impeller periphery and the shredder ring which may be large enough to permit the passage through the openings in the shredder ring of an elongate object, such as a section of a toothpick, without being sheared by the impeller, or only being sheared in half.

Some dishwashers include a drain pump which functions as a valve to control the fluid flow through the drain conduit. For example, U.S. Pat. No. 2,959,179 discloses a dishwasher in which the drain impeller and washing impeller are powered by a reversible motor. When the impeller is rotated in one direction, it drains the solution from the sump by functioning as an axial flow impeller, propelling the washing solution downward and outward from the sump to the drain conduit. When rotated in the opposite direction, the impeller does not permit washing solution to flow to the drain conduit but allows it to be recirculated by the blades of the washing impeller.

A disadvantage of this device is that there is no stationary member to interact with the blades of the impeller to shear food soil into smaller pieces. Therefore, hard or stringy objects suspended in the fluid being pumped by the impeller may not be comminuted at all. Furthermore, there is no means for retaining large food particles in the vicinity of the impeller until they are sufficiently comminuted to reduce the likelihood of their clogging the drain.

The device disclosed in that patent possesses a disadvantage similar to that of the devices previously discussed in that the outlet to the drain conduit is positioned directly below the drain impeller, requiring additional space.

Each of the aforementioned patents discloses a centrifugal or axial flow drain pump having an impeller which performs a cutting or grinding function to reduce the size of said particles in the fluid pumped to facilitate removal of soil during draining. However, none discloses a combination pump and comminuting impeller having radially inwardly facing grinding teeth and radially outwardly facing pumping vanes so that seeds, toothpicks, glass, and stringy objects can be sheared, and can comminute the relatively softer food particles, as well.

Accordingly, there is a need for a combination drain pump and grinding apparatus which is capable of shearing food particles to reduce their size, as well as harder material such as seeds, glass or toothpicks; which retains material in the vicinity of the comminuting activity until it is sufficiently comminuted; and which is capable of comminuting long or stringy material without the use of expensive, closely-toleranced parts.

Summary of the Invention

The combination drain pump and grinding apparatus of the present invention operates effectively as a pump while at the same time comminuting food soil particles and other material to a size sufficiently small to reduce substantially the likelihood of it clogging the conduits which receive the fluid pumped from the assembly. In addition, the combination pump and grinding apparatus is capable of shearing and reducing stringy objects and cigarette filters as well as relatively hard materials such as toothpicks, seeds, small bones, and bits of glass without damage to the components of the assembly. Furthermore, the apparatus retains food soil and other particles in the grinding area of the impeller until sufficiently reduced in size to pass through sizing holes, thus controlling the size of the particles passing through the pump. The assembly of the invention is also much less complicated in structure than prior art devices having similar capabilities with machined parts and is designed to utilize stamped, loosely toleranced parts. Therefore, the assembly of the present invention is relatively less expensive to fabricate and assemble than those prior art devices having machined parts, yet is as efficient.

Although the combination drain pump and grinding apparatus may be used to drain any vessel containing a quantity of fluid having food soil and other material in suspension and having an outlet for draining the liquid from the vessel, it is preferably used to drain the washing solution from the sump of a conventional dishwasher. Such a dishwasher typically consists of a tank defining a wash chamber and having a sump at the bottom, spray means in the wash chamber, a pump motor with an output shaft extending into the sump, a recirculating wash pump with a centrifugal impeller mounted on the output shaft within the sump for pumping washing solution to the spray means for spraying solution over articles in the wash chamber to be cleansed, a drain line for draining the washing solution from the sump, and means defining a drain opening surrounding the shaft below the centrifugal impeller and communicating with the drain line.

The combination drain pump and grinding apparatus of the present invention preferably is integrated with such a dishwasher and includes a housing having a circular side wall and floor defining a pump chamber, a cover plate covering the pump chamber which defines an inlet opening, at least one pump outlet formed in the side wall of the pump chamber and communicating with the drain line, and a waste impeller positioned within the chamber and mounted on the output shaft of the pump motor. The impeller comprises a disc-shaped base substantially parallel to and spaced above the floor of the chamber, an upstanding rim extending about the periphery of the base, and at least one breaker tooth extending upwardly from the base and positioned inwardly of the rim. The base also defines a plurality of soil-sizing orifices, which preferably are spaced about a central axis of the base.

The rim includes an inner wall defining a plurality of radially-offset steps forming alternate, substantially vertical cutting edges and an outer wall defining a plurality of radially-offset steps forming alternate, substantially vertical pumping vanes. The rim preferably is a continuous structure without orifices of any kind and comprises a plurality of inner and outer members arranged in a continuous, alternately overlapping fashion. Each member has a pair of substantially vertically disposed, longitudinal edges such that the edges of the inner members define pairs of opposing surfaces which comprise the cutting edges, and the edges of the outer members define pairs of opposing surfaces comprising the vanes of the pump.

The cover plate includes a downturned lip which extends about the inlet opening and is positioned adjacent the inner wall of the impeller. This overlapping relationship between the outer periphery of the lip and the inner periphery of the upper portion of the inner wall forms a labyrinth seal which creates a tortuous path for the washing fluid from the interior of the impeller to its exterior such that food soil and other material suspended in the fluid is left behind. Therefore, relatively loose tolerances can be allowed for the lip and rim without resulting in a grinding apparatus which permits soil to escape to the drain without first being ground.

The downturned lip preferably includes a stationary tooth having opposing vertical cutting edges which extend downwardly adjacent the inner wall and adjacent the breaker tooth carried on the impeller base. The stationary tooth interacts with the cutting edges of the inner wall and the breaker tooth to shear material suspended in the fluid entering the pump chamber. Due to the cupped shape of the impeller and the labyrinth seal formed by the rim and the downturned lip, the flow path of substantially all of the comminuted material from the cutting surfaces of the impeller to the drain opening is through the plurality of soil-sizing orifices on the base. Soil remains within the cup of the impeller until it has been reduced sufficiently to pass through the orifices. The orifices are sized such that material capable of passing through them presents relatively little danger of clogging the drain line. The interior of the impeller, which is defined by the base and rim, comprises a soil grinding region in which soil is held until reduced in size sufficiently by the interaction of the cutting teeth, stationary tooth, and breaker tooth to pass through the sizing orifices.

Substantially all of the cutting is effected within the cup of the impeller where little or no pumping action is provided. Outside of the cup, the pump vanes provide little cutting action but provide substantially all of the pumping action, creating a suction outside of the impeller to draw the reduced soil through the sizing holes of the floor. Thus, the impeller provides a disposer within the cup upstream of and functioning in series with a pump that draws ground soil through sizing orifices by creating a negative pressure outside of the impeller within the pump chamber.

In a preferred embodiment of the invention, the wall of the pump chamber includes a second outlet opening, spaced from the first, which communicates with a conduit that may lead to other apparatus of the dishwasher, such as a soil collecting chamber. Since the inner and outer walls of the impeller rim include opposing faces which provide the cutting edges and impeller blades respectively, the impeller may be rotated in either direction and provide the same pumping and comminuting action. Therefore, when rotated by a reversible motor, the combination pump and grinding apparatus of the present invention is capable of performing its pumping and grinding operation in both a forward and a reverse mode.

The wall of the pump chamber in the preferred embodiment includes a section extending between the two openings on one side of the pump chamber which is closer to the outer periphery of the impeller than the remainder of the wall, thereby forming a constriction in the passageway which extends between the outer periphery of the impeller and the wall of the pump chamber. During rotation of the impeller in one direction, this constricted passage creates a positive head adjacent a first outlet opening, thereby permitting fluid flow through it, and at the same time creates a negative head adjacent the opening, thereby preventing fluid flow through it. Conversely, rotation of the impeller in an opposite direction creates a positive head adjacent the second opening and a negative head adjacent the first opening, thereby permitting flow through the second opening and restricting it through the first.

Accordingly, it is an object of the present invention to provide a combination pump and grinding apparatus in which a single impeller operates as a disposer in series with a pump which draws ground soil through sizing orifices in the impeller; to provide an apparatus which can be relatively inexpensively manufactured from inexpensive materials and dimensioned to have loose tolerances, yet provide an effective pumping and grinding operation; to provide an apparatus in which hard materials such as toothpicks, seeds, and glass, as well as soft and/or stringy food particles, are reduced until they are of a size which does not present a potential for clogging; to eliminate the need for a known-type of coarse filter by providing in its stead a long, narrow unrestricted entrance way to the drain which traps only soil and other articles larger than the entrance way in more than one dimension across the particle, thus permitting long thin articles such as toothpicks and also objects such as cherry and olive pits, small bones, etc. to enter the disposer for grinding, thereby avoiding the tendency thereof to trap soil; and to provide an apparatus which performs an efficient pumping and comminuting function during both forward and reverse rotation of the pump impeller.

Other objects and advantages of the invention will be apparent from the following description, the accompanying drawings, and the appended claims.

DESCRIPTION OF THE PREFERRED EMBODIMENT

Figure 1:
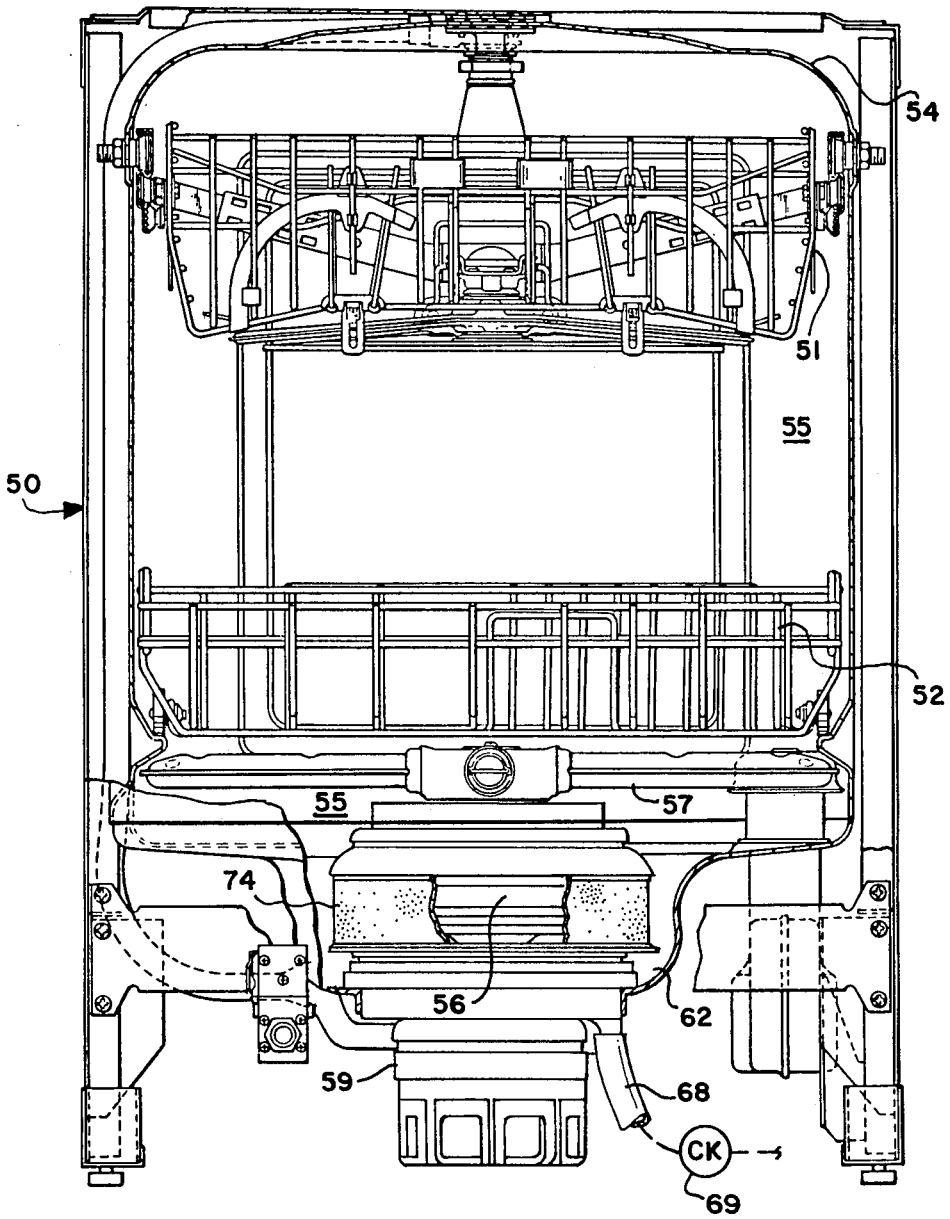
FIG. 1 is a front elevation of a conventional dishwasher with portions partially broken away to reveal the interior of the dishwasher and the combination drain pump and grinding apparatus of the present invention.

As shown in FIG. 1, a warewashing machine such as a domestic dishwasher 50 includes cdnventional upper and lower racks 51, 52 for supporting food ware such as cups, saucers, plates, and silverware, within a tank 54. Tank 54 substantially defines the rear, bottom, sides, and top of a wash chamber 55 within dishwasher 50 where the washing and rinsing of food ware takes place. The front of the chamber 55 is defined by a door (not shown) which closes the tank 54 during washing and rinsing of the food ware.

As shown and described in greater detail in U.S. Pat. No. 4,097,307, issued June 27, 1978, assigned to the assignee of the present invention, and incorporated herein by reference, dishwasher 50 also includes primary spray means consisting in part of a recirculating pump 56, primary spray arms 57 mounted on a fixed shaft 58 (shown in FIG. 2), and drive motor 59 linked to a recirculating pump impeller 60 by drive shaft 61. A sump 62 formed in the bottom of the tank 54 comprises part of the wash chamber 55, and the recirculating pump 56 is positioned within this sump.

Figure 2:
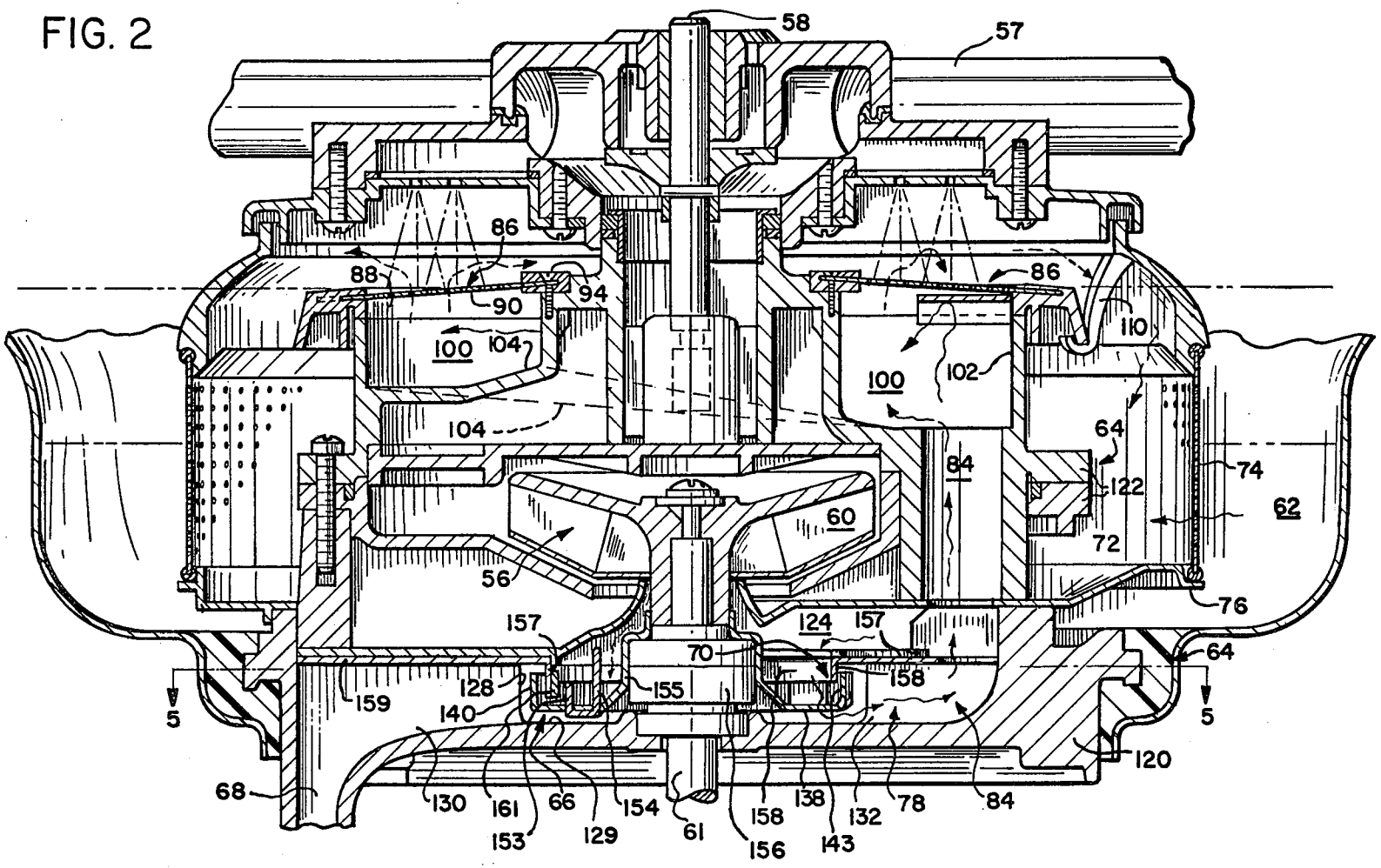
FIG. 2 is an elevation in section of the wash pump and the combination drain pump and grinding apparatus of FIG. 1, the base plate being taken in section at line 2—2 of FIG. 5.
Figure 3:
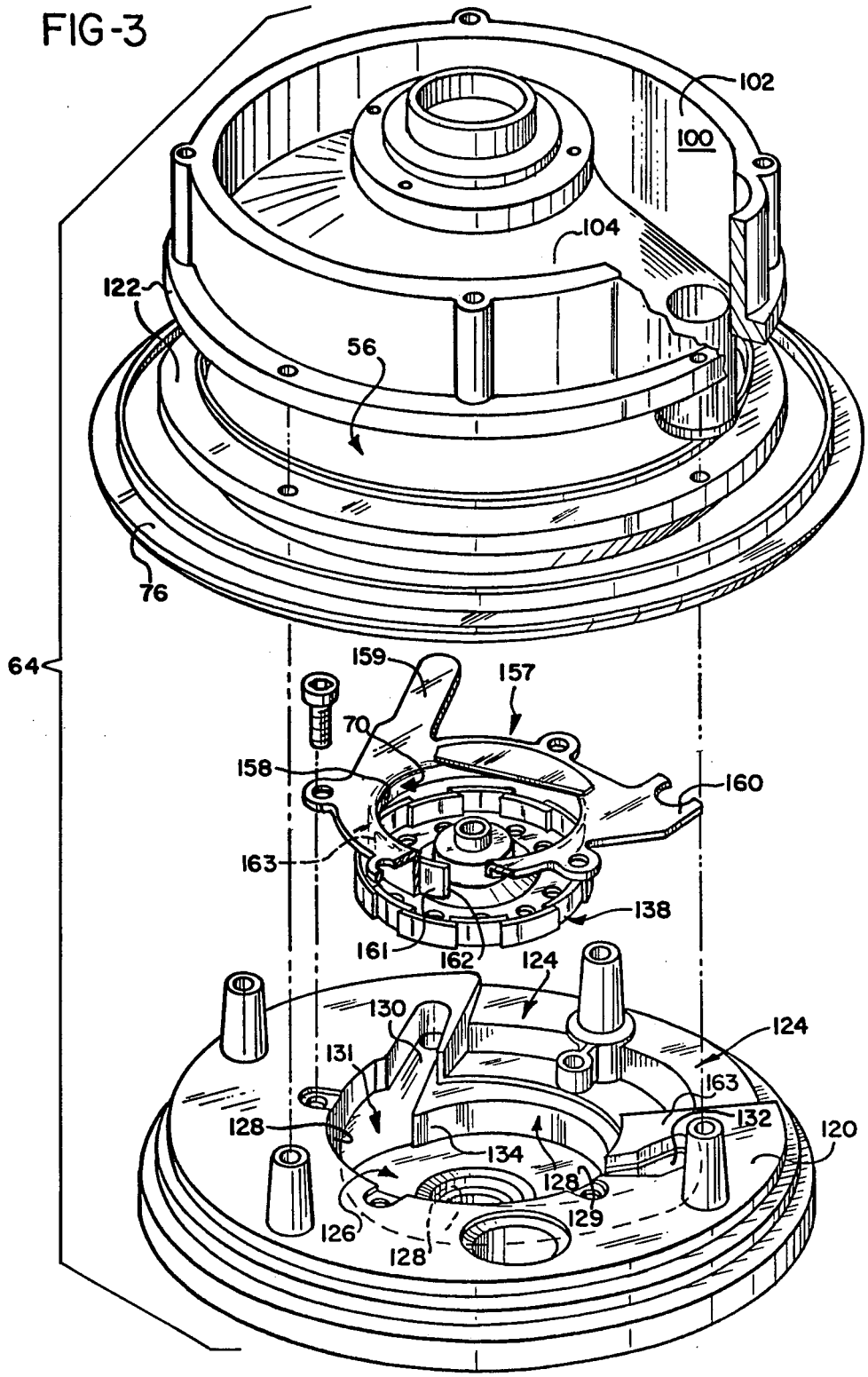
FIG. 3 is an exploded view of the wash pump and combination drain pump and grinding apparatus of FIG. 2.

As shown in FIGS. 2 and 3, a pump housing 64 encloses both recirculating pump 56 and the combination drain pump and grinding apparatus of the preferred embodiment, generally designated 66. The drain pump and grinder 66 preferably forms a part of a drain system which has an opening in the bottom of the sump 62 for receiving and draining the wash and rinse fluids from the dishwasher 50, through a drain line 68 having a check valve 69 (FIG. 1), and into a conventional household drain (not shown), for example.

The drain pump inlet 70 is located beneath the recirculating pump 56 and serves as the inlet to the drain system. The recirculating pump inlet 72 is located in sump 62 slightly above the drain pump inlet 70. Inlet 72 is covered by a main filter screen 74 which is supported by the outer edge of a circular divider plate 76, which forms a part of the pump housing 64, to prevent food soil debris and other material from entering the recirculating pump inlet 72 and blocking or clogging the jet spray orifices in the spray arms 57.

The drain pump and grinding apparatus 66 preferably communicates with a soil collecting circuit 78 which includes a fluid inlet conduit 84 which extends from the drain pump apparatus upwardly past the recirculating pump 56 and into a soil collecting chamber 100 (also shown in FIG. 3) which is mounted above the recirculating pump and has a generally toroidal shape surrounding the fixed shaft 58 defined by an annular wall 102 and a conical floor 104. The collecting chamber 100 is covered by a mesh screen 86 which permits fluid within the chamber to flow outwardly to be utilized by the recirculating pump 56, while straining food soil from it and retaining it within the chamber.

Figure 5:
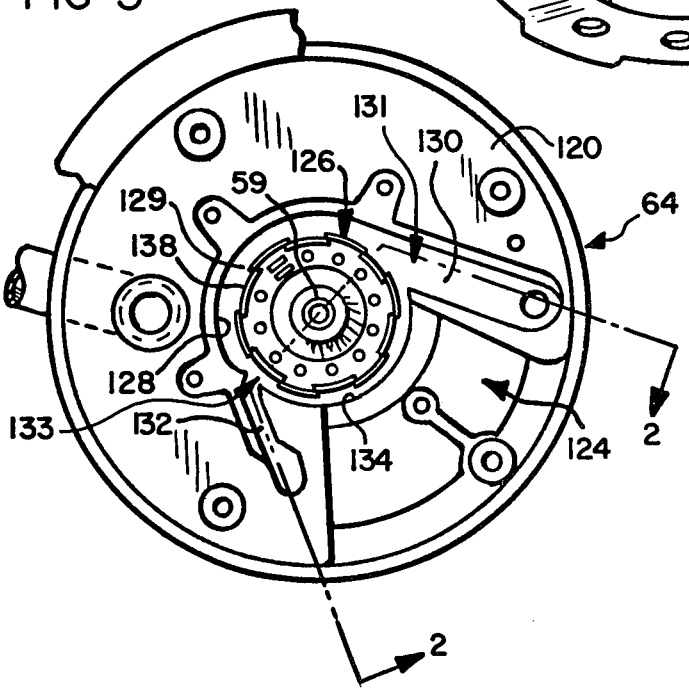
FIG. 5 is a plan view of the drain pump housing of the present invention taken at line 5—5 of FIG. 2.

As shown in FIGS. 2, 3, and 5, the fluid inlet conduit 84 is contained within the pump housing 64. Pump housing 64 includes a lower housing base plate 120 and an upper section 122, which are essentially separated by the divider plate 76. Plate 76 thus constitutes the fluid dividing line between the primary spray means and the drain system. Base plate 120 defines a passageway 124 which comprises a continuation of the sump 62 beneath the upper section 122 to the drain pump inlet 70. Since the drain pump 66 is capable of grinding hard objects such as glass, toothpicks, seeds, bones, and the like, the passageway 124 preferably does not include a coarse filter screen covering the entrance to the passageway. Instead, passageway 124 is relatively long, narrow in a vertical direction, and unrestricted.

The combination drain pump and grinding apparatus 66 of the preferred embodiment is contained within the base plate 120 and includes a pump chamber 126 defined by a substantially circular wall 128 and a floor 129. The base plate 120 also includes a drain channel 130, which forms an integral part of the drain line 68 and communicates with the pump chamber 126 at a pump outlet 131 formed in the wall 128. The base plate 120 also defines a soil collector channel 132 which forms an integral part of the soil collecting circuit 78 and fluid inlet conduit 84. The soil collector channel 132 communicates with the pump chamber 126 at a second pump outlet 133 which is spaced from the pump outlet 131, best shown in FIG. 5. The wall 128 also includes a wall section 134 which extends between the first pump outlet 131 and the second pump outlet 133, and is located beneath the passageway 124. Wall section 134 defines an arc having a radius of curvature which is less than that of the remainder of the wall 128.

Figure 4A:
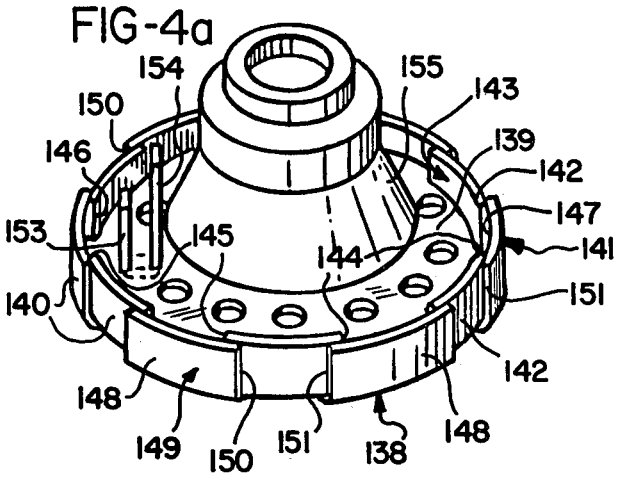
FIG. 4*a* and 4*b* are perspective views of the impeller of the present invention.
Figure 4B:
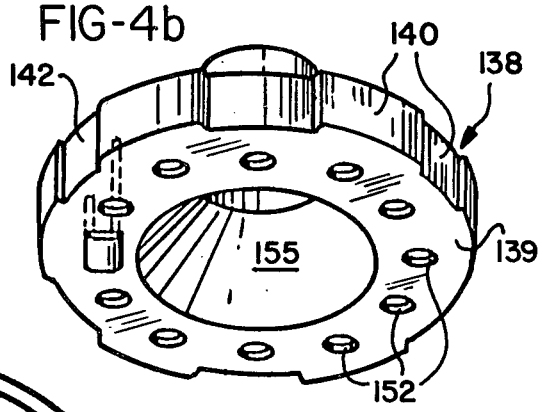

As shown in FIGS. 2, 3, and 5, a drain impeller, generally designated 138, is mounted within the pump chamber 126 on drive shaft 61 and is sized to provide a circular fluid passageway between the impeller and the circular wall 128. The impeller is positioned within the chamber 126 such that a constricted passageway is formed between the impeller and wall section 134 (best shown in FIG. 5) that is narrower in width than the remainder of the passageway about the impeller. As shown in FIGS. 4A and 4B, the impeller 138 includes a disc-shaped base 139 having a plurality of upturned, overlapping members 140 formed about its periphery. Each member 140 is generally plate-shaped, and the members are alternately overlapping to form a continuous rim 141 without openings therethrough. The radially inner ones 142 of the upturned members 140 form an inner wall 143. The inner members 142 each include opposing, radially extending vertical surfaces 144, 145 whose radially inner edges 146, 147, respectively, form the cutting edges of the impeller 138.

Similarly, the radially outer ones 148 of the upturned members 140 form an outer wall 149. Each outer member 148 includes opposing, radially extending vertical surfaces 150, 151 which act as the vanes of the impeller 138.

The base 139 of the impeller 138 includes a plurality of soil-sizing holes 152, which are spaced about the base in a circular pattern. As shown in FIGS. 2, 4A, and 4B, the base 139 also includes breaker teeth 153, 154 which extend upwardly from the base and are located radially inwardly from the inner wall 143. The base 139 also includes a central hub 155 which is located concentrically with respect to the base and is shaped to fit over a water seal 156 carried by the output shaft 61 of the pump (shown in FIG. 2).

As best shown in FIGS. 2 and 3, the pump chamber 126 is closed by a cover plate 157 which is mounted within a recess formed in the base plate 120 above the floor 129 of the pump chamber. The cover plate 157 includes a central orifice which defines the drain pump inlet 70. The cover plate 157 includes a downturned lip 158 which extends about the pump inlet 70 and is curved downward toward the base 139 of the impeller 138.

The downturned lip 158 is positioned to overlap the radially inward periphery of the inner wall 143 at an upper portion thereof. The gap formed between the outer circumferential periphery of the downturned lip 158 and the inner periphery of the inner wall 143 overlapped by the lip, and the gap formed between the upper surface of the inner wall and the adjacent surface of the underside of the cover plate together form a labyrinth seal which creates a tortuous path for fluid flowing between the downturned lip and the rim of the impeller. The gap formed can be as wide as 0.030 inches and still provide a seal which prevents food soil and other material suspended within the fluid in the region defined by the impeller base 139 and rim 141 from flowing through the gap.

Figure 6:
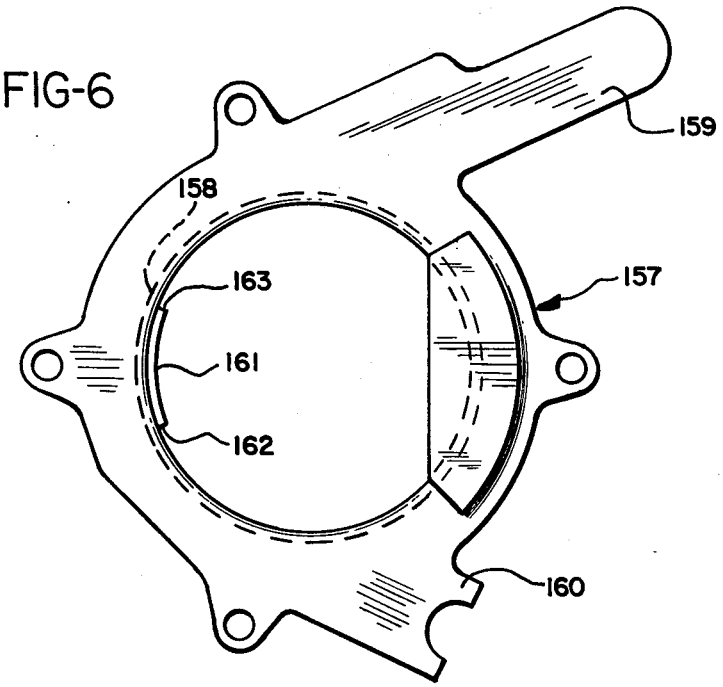
FIG. 6 is a plan view of the cover plate of the preferred embodiment.

The cover plate 157 also includes arms 159, 160 which extend over and close the drain channel 130 and extend over to define an opening in the soil collector channel 132, respectively. As shown in FIGS. 2, 3 and 6, the cover plate 157 includes a stationary tooth 161 which is attached to and extends downwardly from the downturned lip 158. The stationary tooth 161 is curved to follow the arcuate contour of the downturned lip 158 in the section where it is attached. The tooth 161 includes a pair of opposing faces 162, 163. As shown in FIG. 2, the tooth 161 extends downwardly between the inner periphery of the inner wall 143 and the breaker tooth 153.

The space between the stationary tooth 161 and the inner members 142 is sufficiently small that rotation of the impeller 138 provides a shearing action between the cutting edges 146, 147 of the inner members 142 and the radially outer edges of the opposing faces 162, 163, respectively, of the stationary tooth. The stationary tooth 161 is preferably of sufficient length, measured along a circumferential axis, to provide the necessary strength to enable the shearing action previously described to comminute hard objects such as seeds, toothpicks, and glass. In addition, the gap between the stationary tooth 161 and the breaker tooth 153 is sufficiently close so that the breaker tooth interacts with the stationary tooth to provide a shearing action which also comminutes hard objects such as those previously described. Breaker tooth 154, which extends upwardly from the base 139 of the impeller 138 through the inlet opening 70, acts during impeller rotation to knock objects into the inlet opening where they can be comminuted by the aforementioned shearing action.

The operation of the preferred embodiment of the invention is as follows. During a recirculating mode of operation of the dishwasher 50, the drive motor is activated to rotate the output shaft, and hence the impeller 126, in a counterclockwise direction as it is shown in FIG. 5. This causes the recirculating pump impeller to pump fluid from the sump 62 through the recirculating pump 72 and out the spray orifices in the primary spray arms 57.

The fluid leaving the spray arms 57 impinges upon the food ware carried in the upper and lower racks 51, 52 within the wash chamber 55, and dislodges food soil and other debris from the ware. The fluid and food soil then falls from the food ware into the sump 62 of the wash chamber 55. The concentration of food soil and other debris within the fluid contained in the sump 62 increases as a result of the accretion of food soil dislodged from the food ware within the wash chamber 55. However, the food soil within the washing fluid contained in the sump 62 is not permitted to enter the recirculating pump inlet 72 since the fluid entering the inlet is filtered through the main filter screen 74.

At the same time that the recirculating pump is performing its cleansing action upon the food ware, washing solution within the sump 62, and the food soil and other material suspended within it, flows from the sump through the passageway 124, over the cover plate 157, and through the drain pump inlet 70 into the drain pump chamber 126. The fluid flowing through the inlet 70 impinges upon the spinning base 139 of the rotating drain impeller 138 and is driven outwardly by the hydraulic force of fluid above it and the centrifugal force of rotation imparted to it from the base. The food soil and other material within the fluid encounters the shearing action of the inner edges 146 of the vertical surfaces 144 of the inner members 142, and the radially outer edges of the face 163 of the stationary tooth 161. In addition, elongate objects, such as toothpicks and small bones, are broken up by the coaction of the breaker tooth 153, stationary tooth 161, and the aforementioned cutting edges 146. The food soil is held within the food grinding region, defined by the base and rim of the impeller, and is continuously subjected to the shearing action of the stationary tooth, inner members, and breaker tooth.

While this grinding or comminuting activity is occuring, wash fluid flows downwardly through the soil sizing holes 152 and, as a result of the centrifugal force of the spinning impeller 138, is thrown against the wall 128 of the pump chamber 126 where it is urged along the circular passageway by the vane-like surfaces 150 of the outer members 148 in a counterclockwise direction. This fluid is thus forced to flow along the wall 128 to the second pump outlet 133 and soil collector channel 132. Once the food soil and other material has been comminuted to a sufficiently small size, it, too, flows through the soil-sizing holes 152 and is carried with the washing solution through the second pump outlet 133 to flow upwardly through the fluid inlet conduit to be stored within the soil collecting chamber 100. Thus, the cupped shape of the impeller 138, which defines the food grinding region within the pump chamber 126 which is bounded by the base 139 and rim 141 of the impeller, holds food soil and other material and repeatedly grinds and shears it until reduced to particles of a size sufficiently small to pass through the soil sizing holes 152.

The wall section 134 which provides a relatively constricted section of the passageway between the first pump outlet 131 and the second pump outlet 133, creates a negative pressure area defined by the outer wall 149 of the impeller 138, the cover plate 157, and the floor 129, since the velocity of the fluid in this region is greater than for the rest of the passageway. This negative pressure area is upstream of and thus prevents fluid from flowing through the first pump outlet 131 and along the drain channel 130 during this mode of operation. The negative pressure area is downstream of, and hence does not impede the fluid flow to, the second pump outlet 133. There is no need for a valve mechanism to prevent fluid flow through the drain line 68 during the recirculating mode.

In the preferred embodiment, the wall section 134 is shaped to create several inches of negative pressure upstream of the opening of the first pump outlet 131. Should the mesh screen 86 (FIG. 2) become partially clogged with food soil, thereby creating a backpressure along the fluid inlet conduit 84 and soil collector channel 132 and reducing the negative head at the outlet 131, there will still be sufficient negative head at the outlet to prevent fluid from flowing to the drain line 68. However, since during the recirculating mode there usually is a negative pressure head sufficient to draw fluid out of the drain line 68 and into the pump chamber 126, the check valve 69 is employed to prevent reverse flow of fluid from the drain line back into the pump chamber.

As the impeller 128 is rotated in a counterclockwise direction, it is the surfaces 150 of the outer members 148 which act as impeller vanes, urging the fluid to flow in a counterclockwise direction. During this mode of rotation the surfaces 151 do not act upon the fluid in the chamber 126. Similarly, the inner cutting edges 146 are interacting with the stationary tooth 161 during this mode of operation, while the cutting edges 147 of the inner members 142 are inactive.

After the dishwashing machine 50 has completed its fluid recirculating mode of operation, it commences a fluid draining mode of operation. The drive motor 59 reverses its rotation of the drive shaft 61 so that the recirculating pump impeller 60 and the drain impeller 138 rotate in a clockwise direction as viewed in FIG. 5. The recirculating pump impeller 60 is shaped so that it does not pump fluid to the spray arms 57 during this mode.

However, clockwise rotation of the drain pump impeller 138 causes the fluid to rotate in an opposite sense within the pump chamber 126 than during the recirculating mode. In the draining mode of operation the comminuting function continues, but the shearing action is between the cutting edges 147 of the inner members 142 and the radially outer portion of the opposing face 162 of the stationary tooth 161. The cutting edges 146 and the opposing face 163 are inactive during this mode of operation.

Similarly, the surfaces 151 of the outer members 148 act as impeller vanes to urge the fluid within the circular passageway within the pump chamber 126 in a clockwise direction. The constriction between the outer periphery of the impeller 138 and the wall section 134, which now is upstream of second pump outlet 133 and downstream of first pump outlet 131, creates a negative pressure area which causes fluid to flow through the first pump outlet 131 and along the drain channel 130, and prevents fluid flow into the second pump outlet 133 and soil collector channel 132. Since the recirculating pump impeller 60 is no longer pumping wash fluid onto the food ware, most of the wash fluid is in the sump 62, where it drains through the passageway 124 to the drain pump 66. The soil collector chamber 100, having been filled with food soil during the recirculating mode, is now drained of its contents since wash fluid is not being pumped through the fluid inlet conduit 84. Now, the contents flow from the chamber 100 to the collector channel 132, where it is pumped around the pump chamber 126 in the drain channel 130. Thus, clockwise rotation of the impeller 138 causes the comminuted food soil and other material, and the accompanying washing fluid, to flow to the drain line 68.

Although in the preferred embodiment of the invention the pump chamber 126 defines two pump outlets 131, 133, the drain pump and grinder 66 can function effectively in a dishwasher having but one pump outlet from its drain pump chamber to a drain line. With such an embodiment, a pump chamber would not need a side wall having a section forming a constriction in the fluid path about the periphery of the impeller, but the drain line could employ a mechanical drain valve to selectively permit fluid flow from the pump chamber through the drain line. With such an embodiment, a single direction pump motor could be used. Alternatively, the drain pump and grinder of the invention could be utilized with a single outlet pump chamber and driven by a reversible motor. In such an embodiment, if the configuration of the drain pump chamber was that of the preferred embodiment (with a constricted section 134 shown in FIG. 5) rotation of the impeller would pump fluid to the single drain in one direction of rotation, and prevent fluid flow to the drain line opening when rotated in an opposite direction, thus acting as a drain valve. However, a check valve would be needed for reasons previously discussed.

The combination drain pump and grinding apparatus of the preferred embodiment can be made from any materials which are sufficiently strong and can withstand contact with water and cleaning agents. However, the stationary tooth 161 and the drain impeller 138 preferably are made of stainless steel to provide the necessary strength and resistance to corrosion required for long life. The lower housing base plate 120 may be made from any hardened material, but preferably is made from a cast phenolic. Many types of thermoplastics can also be used.

While the form of apparatus herein described constitutes a preferred embodiment of this invention, it is to be understood that the invention is not limited to this precise form of apparatus, and that changes may be made therein without departing from the scope of the invention.

What is claimed is:

1. In combination with a vessel for containing a quantity of fluid having food soil suspended therein and having a drain line for draining fluid therefrom, a combination drain pump and grinding apparatus for grinding food soil and pumping fluid and food soil from said vessel through said drain line, comprising:

housing means having a side wall and a floor defining a pump chamber;

means defining an inlet opening above said pump chamber and communicating with said vessel;

said housing means defining at least one pump outlet extending through said side wall and communicating with said chamber and with said drain line;

a waste impeller positioned within said chamber and having a disk-shaped base substantially parallel to and spaced above said floor, said base defining a plurality of soil-sizing orifices therethrough, an upstanding rim extending about a periphery of said base and including an inner wall defining a plurality of radially-extending, substantially vertical cutting edges and an outer wall defining a plurality of radially-extending, substantially vertical pumping vanes, and at least a first breaker tooth extending upwardly from said base and positioned inwardly of said rim;

at least one stationary tooth having a vertical cutting edge extending downwardly adjacent said inner wall such that rotation of said impeller causes said stationary tooth to pass between said inner wall and said breaker tooth such that said cutting edges come into opposing close proximity to said cutting edge of said tooth;

means for mounting said impeller for rotation about a vertical axis; and means associated with said mounting means for rotating said impeller.

2. The assembly of claim 1 wherein:

said rim comprises a plurality of inner and outer members arranged in a continuous, overlapping fashion, each member having a pair of substantially vertically disposed, longitudinal edges such that said edges of said inner members define pairs of opposing surfaces comprising said cutting edges, and said edges of said outer members define pairs of opposing surfaces comprising said vanes; and said stationary tooth includes a pair of opposing faces which define cutting edges such that said impeller may perform a food soil grinding and pumping function when rotated in either direction by said rotating means.

3. The assembly of claims 1 or 2 further comprising a second breaker tooth extending upwardly from said base and positioned radially inwardly from said first breaker tooth such that said second tooth extends into said inlet opening so that objects extending into said opening above said chamber may be dislodged by said second tooth to fall through said inlet opening.

4. The assembly of claim 1 wherein said side wall defines a substantially circular contour having a minimum clearance with said impeller adjacent a downstream side of said outlet, and a maximum clearance with said impeller adjacent an upstream side of said outlet.

5. The assembly of claim 4 wherein said means defining an inlet opening comprises a cover plate positioned over said chamber and including an orifice, concentric with said impeller, forming said inlet opening, said cover plate having a downturned lip extending about said inlet opening and positioned adjacent said inner wall of said rim thereby forming a labyrinth seal therewith, said lip supporting said stationary tooth.

6. In combination with a vessel for containing a quantity of fluid having food soil suspended therein and having a drain line for draining fluid therefrom, a combination drain pump and grinding apparatus for grinding food soil and pumping fluid and food soil from said vessel through said drain line, comprising:

housing means having a side substantially circular side wall and a floor defining a pump chamber;

a cover plate positioned over said chamber and defining an inlet opening communicating with said chamber and with said vessel, said plate including a downturned lip extending about said opening;

said housing means defining a first pump outlet extending through said side wall and communicating with said chamber and said drain line, and a second pump outlet extending through said side wall communicating with said chamber and spaced from said first outlet;

a waste impeller positioned within said chamber and housing a disk-shaped base substantially parallel to and spaced above said floor, said base defining a plurality of soil-sizing orifices therethrough, an upstanding rim extending about a periphery of said base and including an inner wall defining a plurality of radially-extending, substantially vertical cutting edges and an outer wall defining a plurality of radially-extending, substantially vertical pumping vanes, said rim extending upwardly such that an upper portion thereof overlaps an outer periphery of said downturned lip to form a labyrinth seal therewith, and at least a first breaker tooth extending upwardly from said base and positioned inwardly of said rim;

at least one stationary tooth having a vertical cutting edge attached to said downturned lip and extending downwardly adjacent said inner wall such that rotation of said impeller causes said stationary tooth to pass between said inner wall and said breaker tooth such that said vertical cutting edges come into opposing close proximity to said cutting edge of said tooth;

means for mounting said impeller for rotation about a vertical axis; and means for rotating said impeller in either a forward or a reverse direction, said rotating means driving said mounting means.

7. The apparatus of claim 6 further comprising conduit means communicating with said second outlet and with soil collecting means.

8. In combination with a vessel for containing a quantity of fluid having food soil suspended therein and having a drain line for draining fluid therefrom, a combination drain pump and grinding apparatus for grinding food soil and pumping fluid and food soil from said vessel through said drain line, comprising:

housing means having a side wall and a floor defining a pump chamber;

means defining an inlet opening above said pump chamber and communicating with said vessel;

said housing means defining at least one pump outlet extending through said side wall and communicating with said chamber and with said drain line;

a waste impeller positioned within said chamber and having a disk-shaped base substantially parallel to and spaced above said floor, said base defining a plurality of soil-sizing orifices therethrough, an upstanding, continuous rim extending about a periphery of said base and including an inner wall having means defining a plurality of rotary cutting edges, and an outer wall defining a plurality of vane surfaces about an outer periphery of said rim;

said inlet opening means including rim means associated with a proximate portion of said rim thereby forming a labyrinth seal therewith such that said rim and said base define a soil grinding region for retaining and grinding food soil until reduced in size sufficiently to pass through said soil-sizing orifices;

means defining a stationary cutting edge extending downwardly within said soil grinding region adjacent said rotary cutting edges such that rotation of said impeller causes said stationary cutting edge to effect a shearing action with said rotary cutting edges;

means for mounting said impeller for rotation about a vertical axis; and means associated with said mounting means for rotating said impeller.

* * * * *